US005555226A

United States Patent [19]

Lizzi

[11] Patent Number: 5,555,226

[45] Date of Patent: Sep. 10, 1996

[54] AUTOMATIC SETTING OF ALTERNATE TIME ZONE DATA IN A MULTIMODE ELECTRONIC TIMEPIECE

[75] Inventor: Ronald S. Lizzi, West Hartford, Conn.

[73] Assignee: Timex Corporation, Middlebury, Conn.

[21] Appl. No.: 503,363

[22] Filed: Jul. 17, 1995

[51] Int. Cl.[6] ..... G04B 19/22

[52] U.S. Cl. ..... 368/21

[58] Field of Search ..... 368/21

[56] References Cited

U.S. PATENT DOCUMENTS

| | | | |
|---|---|---|---|
| 4,821,248 | 4/1989 | Yamasaki | 368/21 |
| 4,884,254 | 11/1989 | Kawai et al. | 368/21 |
| 4,956,829 | 9/1990 | Mitchell | 368/185 |
| 4,998,229 | 3/1991 | Kubota | 368/21 |
| 5,008,866 | 4/1991 | Thinesen | 368/21 |

*Primary Examiner*—Bernard Roskoski
*Attorney, Agent, or Firm*—William C. Crutcher

[57] ABSTRACT

A multimode electronic timepiece includes a display, a plurality of manually actuated switches, and an integrated circuit having memory locations. The integrated circuit is programmed to keep time and to provide a plurality of modes, including time-of-day and at least one alternate time zone. The integrated circuit is further programmed to permit an operator of the multimode electronic timepiece to set the time-of-day and the alternate time zone in response to actuation of selected switches, and to store the time-of-day and the alternate time zone data in the memory locations. The improvement comprises a flag means which will copy the contents of the memory location storing the time-of-day data to the memory location for the alternate time zone data when the time-of-day has been set and the alternate time zone has not been set by the operator.

1 Claim, 5 Drawing Sheets

AUTOMATIC SETTING OF ALTERNATE TIME ZONE DATA IN A MULTIMODE ELECTRONIC TIMEPIECE

BACKGROUND OF THE INVENTION

This invention relates generally to the setting of alternate time zone data in electronic timepieces. More specifically, the invention simplifies the setting of alternate time zone data by reducing the number of steps which a timepiece operator must complete in order to set the alternate time zone data.

Electronic timepieces which are capable of displaying the time, date and day of the week (DOTW) in multiple time zones are well known in the art. Such timepieces are particularly desirable for those individuals who travel frequently between cities located in different time zones, thus requiring the time, date and DOTW information for more than one time zone. For example, an individual traveling from New York City to Moscow, via Paris, may want to know the time upon his arrival to each destination. Similarly, a businessperson located in New York City may wish to know the time and date information for Paris and Moscow to coordinate business arrangements with foreign associates.

A difficulty encountered with the aforementioned timepieces is that immediately after the initial purchase, or immediately after the timepiece power source has been replaced, numerous procedural steps must be carried out to set the data for each of the multiple time zones. Most often, this means setting all of the data for time, date and DOTW in each time zone. As the number of time zones available in the timepiece increases, the task of setting all of the data for each of the time zones proves cumbersome and increasingly subject to operator error.

Several proposals have been made to improve and simplify the setting of alternate time zone data. For example, U.S. Pat. No. 4,821,248, issued on Apr. 11, 1989, discloses a timepiece having a fundamental (or home) time which may be set to a time other than that of one of a plurality of alternate (or world) time zone times which has been stored in memory. The '248 patent simplifies the setting of a selected one of the plurality of alternate time zone times by interlocking the setting of that world time zone time with the setting of the fundamental time. In accordance with the fundamental time correcting mode of the invention, if the amount by which the fundamental time is to be corrected is greater than a preset time-differential unit (which in the preferred embodiment is thirty minutes), then the time setting of the selected one of the alternate time zones will not be affected by the setting of the fundamental time. However, if the amount by which the fundamental time is to be corrected is less than the preset time-differential unit, the time setting of the selected one of the alternate time zones will be "interlocked" to the fundamental time, and therefore, its setting will be changed simultaneously with that of the fundamental time zone time.

Another proposal, U.S. Pat. No. 4,884,254, issued on Nov, 28, 1989, discloses a time display device having logic means adapted to call up a predetermined number of preselected cities from memory and to display the list on the device's display. Upon selection of one of the preselected cities through operation of an instruction key, the time for the selected city is determined by calling up the time difference corresponding to the selected city (which is itself stored in memory), and then adding it to the current time as outputted from the device's timing means. This selected city is then stored in memory as the first listed city in order to facilitate call-up.

While these inventions simplify the setting of alternate time zones, the setting of each alternate time zone data must still be done on an individual basis. That is, under the '248 patent, only the time setting of one alternate time zone will be "interlocked" when the amount by which the fundamental time is to be corrected is less than the preset time-differential unit. Similarly, under the '254 patent, each alternate time zone time (in the form of a city) must be called-up in order for the timepiece to correct the same. It is therefore one object of the invention to simplify the setting of alternate time zones in an electronic timepiece.

Another object of the invention is to simplify the initial setting of alternate time zones in an electronic timepiece after purchase by a consumer.

Still another object of the invention is to simplify the initial setting of alternate time zones in an electronic timepiece after battery replacement by a user.

An additional object of the invention is to simplify the initial setting of all alternate time zones in an electronic timepiece irrespective of the specific identity of the alternate time zone.

SUMMARY OF THE INVENTION

Briefly stated, the invention is an improvement of a multimode electronic timepiece of the type having a display, a plurality of manually actuated switches, and an integrated circuit having memory locations, the integrated circuit being programmed to keep time, to provide a plurality of modes, including time-of-day and at least one alternate time zone, to permit an operator of the timepiece to set the time-of-day and the alternate time zone in response to actuation of selected switches, and to store the time-of-day and the alternate time zone data in the memory locations. The improvement comprises flag means for copying the contents of the memory location storing the time-of-day data to the memory location for the alternate time zone data when the time-of-day has been set and the alternate time zone has not been set by the operator, the copied contents in the memory location for the alternate time zone data being displayed on the display in response to actuation of a selected switch and being changed in further response to actuation of selected switches, the flag means including a flag bit set in one of the memory locations of the integrated circuit, the value of the flag bit being dependent upon whether or not the operator has set the alternate time zone.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

DESCRIPTION OF THE PREFERRED EMBODIMENT

Figure 1:
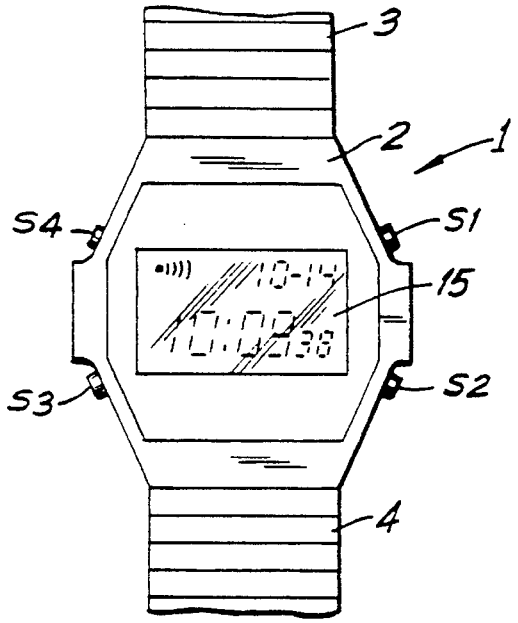
PRIOR ART FIG.1
FIG. 1 is a plan view of a typical multimode electronic timepiece in simplified form.

Referring now to FIG. 1 of the drawings, a typical multimode electronic timepiece 1 in the form of a wristwatch includes a case 2 adapted to be held on the wrist by a strap, portions of which are seen at 3 and 4. The case 2 has four manual push button actuators S1, S2, S3 and S4, also referred to as switches, arranged to close spring contacts (not shown) inside the timepiece case 2. An electro-optic display 15, which is commonly a liquid crystal display (LCD), exhibits digits, letters or other symbols when activated by a microcomputer inside the watch 1. The microcomputer is manifested in the form of an integrated circuit.

Figure 2:
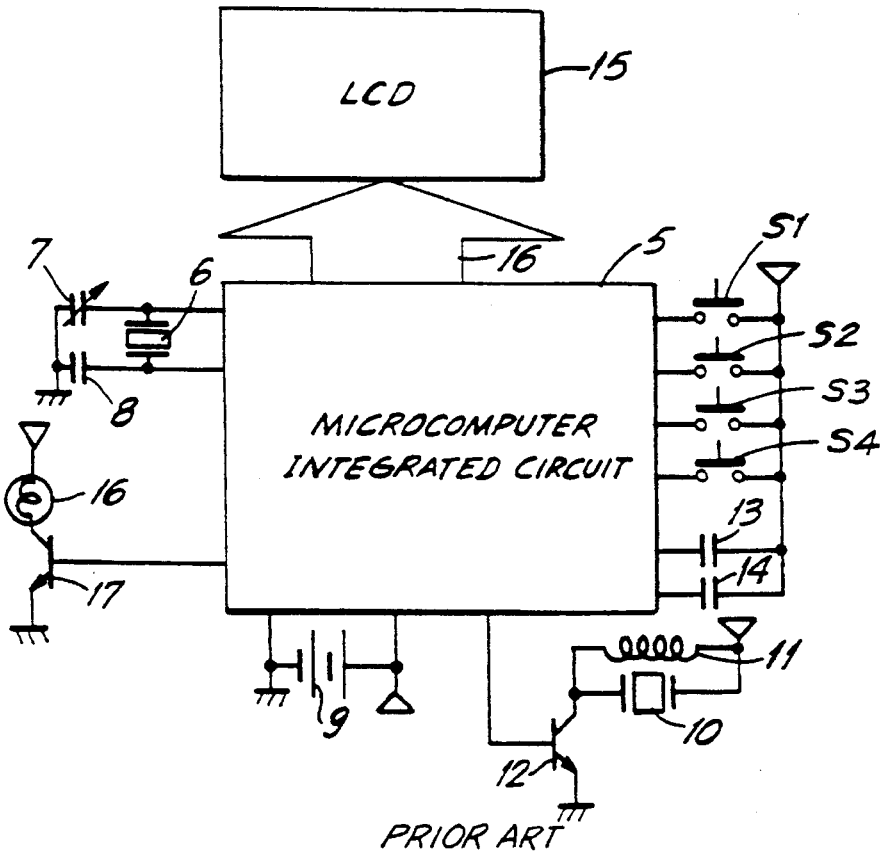
PRIOR ART FIG.2
FIG. 2 is a block diagram of a circuit for the timepiece of FIG. 1, together with external components such as lamp, switches and display.

FIG. 2 is a schematic block diagram of the electrical connections in accordance with conventional multimode electronic timepiece technology well known to those skilled in the art. A programmable microcomputer 5, in the form of a mask-programmable integrated circuit, is bonded to a printed circuit board (not shown), and includes suitable pin connections and leads connected to various external components shown in the diagram which are also mounted on the printed circuit board. The microcomputer 5 also includes a microprocessor, an operating system program for carrying out instructions, and memory locations.

A quartz crystal 6 coupled to capacitors 7 and 8 and connected to the oscillator pins of the integrated circuit 5 provides a high-frequency time base. A battery power source 9 is provided in the form of a button type energy cell in the watch case 2. A watch alarm is composed of a piezoelectric crystal 10, an inductance coil 11 and a drive transistor 12. Two fixed external capacitors 13 and 14, in conjunction with other circuit elements combined inside the integrated circuit 5, serve to boost the output voltage to drive the LCD 15 (also shown in FIG. 1) via a display bus 16, which represents several parallel leads connected to the various actuable segments of the LCD 15. The LCD 15 is positioned in proximity to a lamp 17 so that when the lamp 17 is lit by a switching signal from the integrated circuit 5 applied to the base of a switching transistor 18, the LCD 15 will become illuminated.

Figure 3:
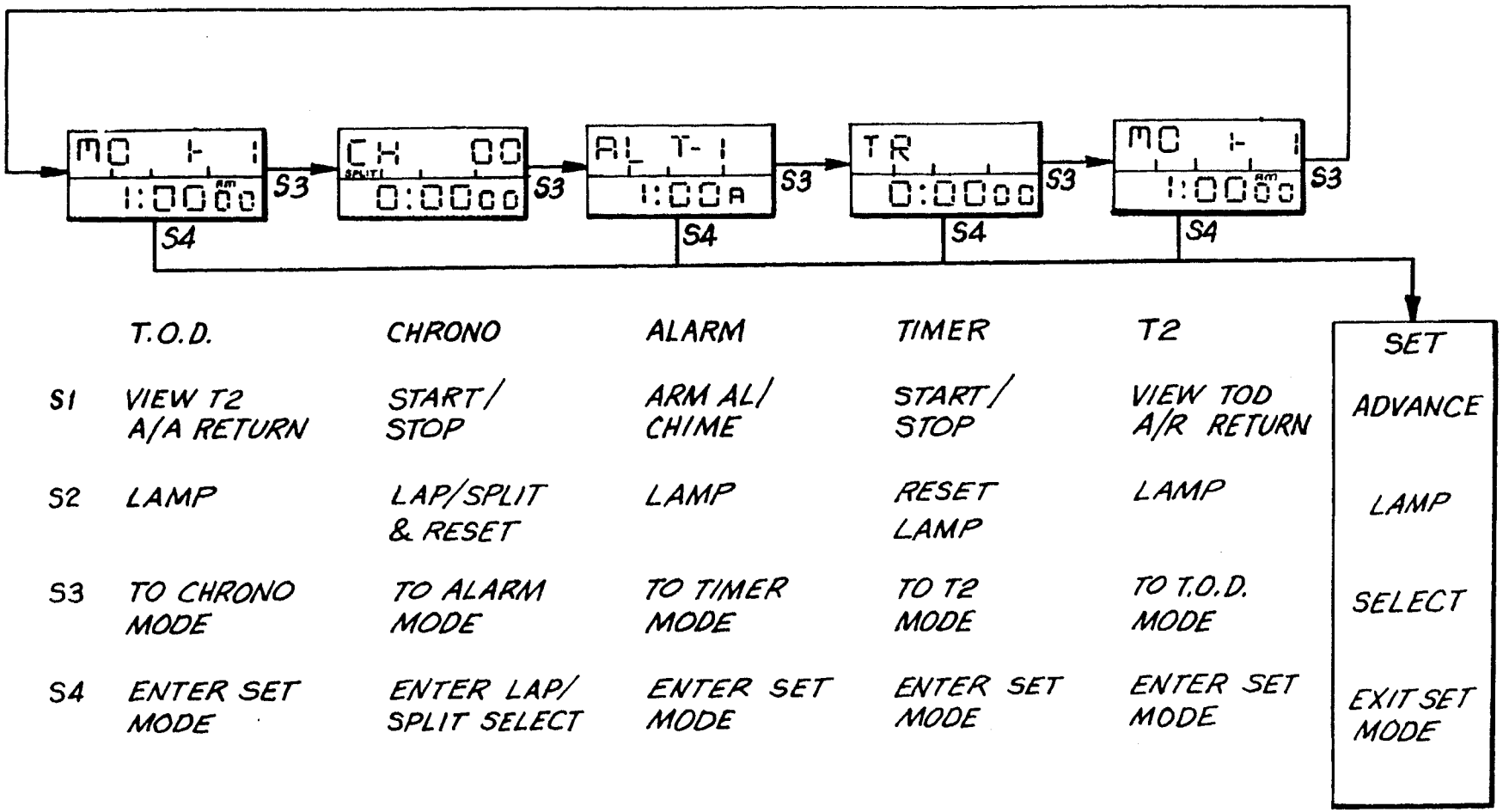
PRIOR ART FIG. 3
FIG. 3 is a block diagram of the multimode timepiece of FIG. 1 illustrating the sequence of modes in response to manually actuated switches.

Referring now to FIG. 3, a block diagram of the typical multimode electronic wristwatch 1 illustrates the sequence of modes or states in response to manually actuating switches S1–S4 in accordance with the table. Each of the blocks illustrates the appearance of the display 15 at start-up for the modes shown. Beneath each of the display blocks is a column illustrating what happens when the respective switches S1–S4 are actuated while in that mode. The modes for this particular timepiece are time-of-day (TOD), chronograph (CHRONO), alarm setting (ALARM), elapsed time (TIMER), and alternate time zone (T2). Note that these modes are only representative of the various modes available for multimode electronic wristwatches. As indicated in the row opposite switch S3, the program is arranged to shift modes sequentially in a continuous loop. Once in one of the five modes illustrated, actuation of switch S4 causes execution of a subroutine SET for changing the information displayed. Switch S3 will SELECT a particular piece of information which is indicated on the display by "flashing" the indicia for that piece of information, and switch S1 will ADVANCE the value of said piece of information. The operation illustrated in FIG. 3 is well known in the art.

Figure 4:
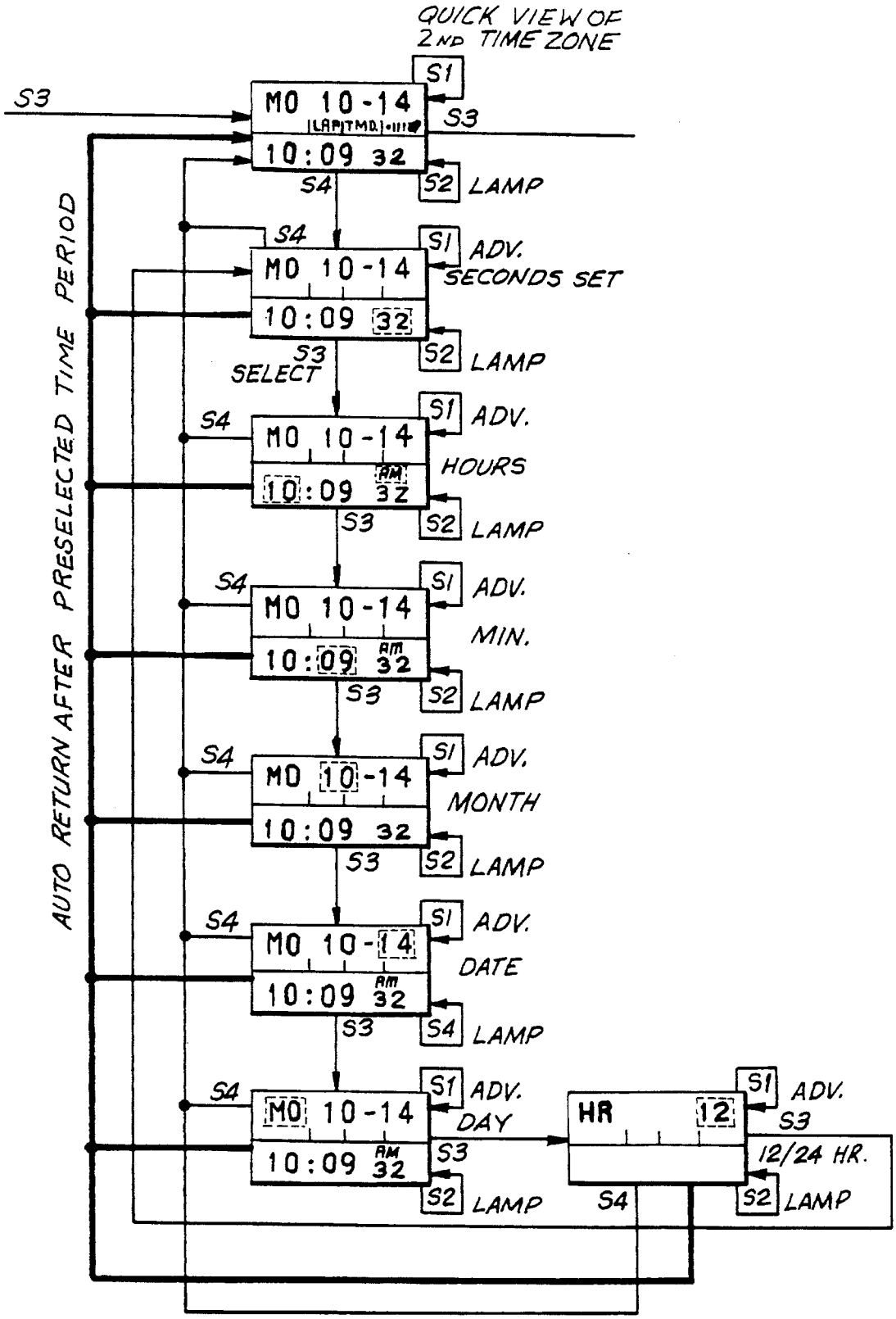
PRIOR ART FIG.4
FIG. 4 is a detailed state diagram of time-of-day set mode.
Figure 5:
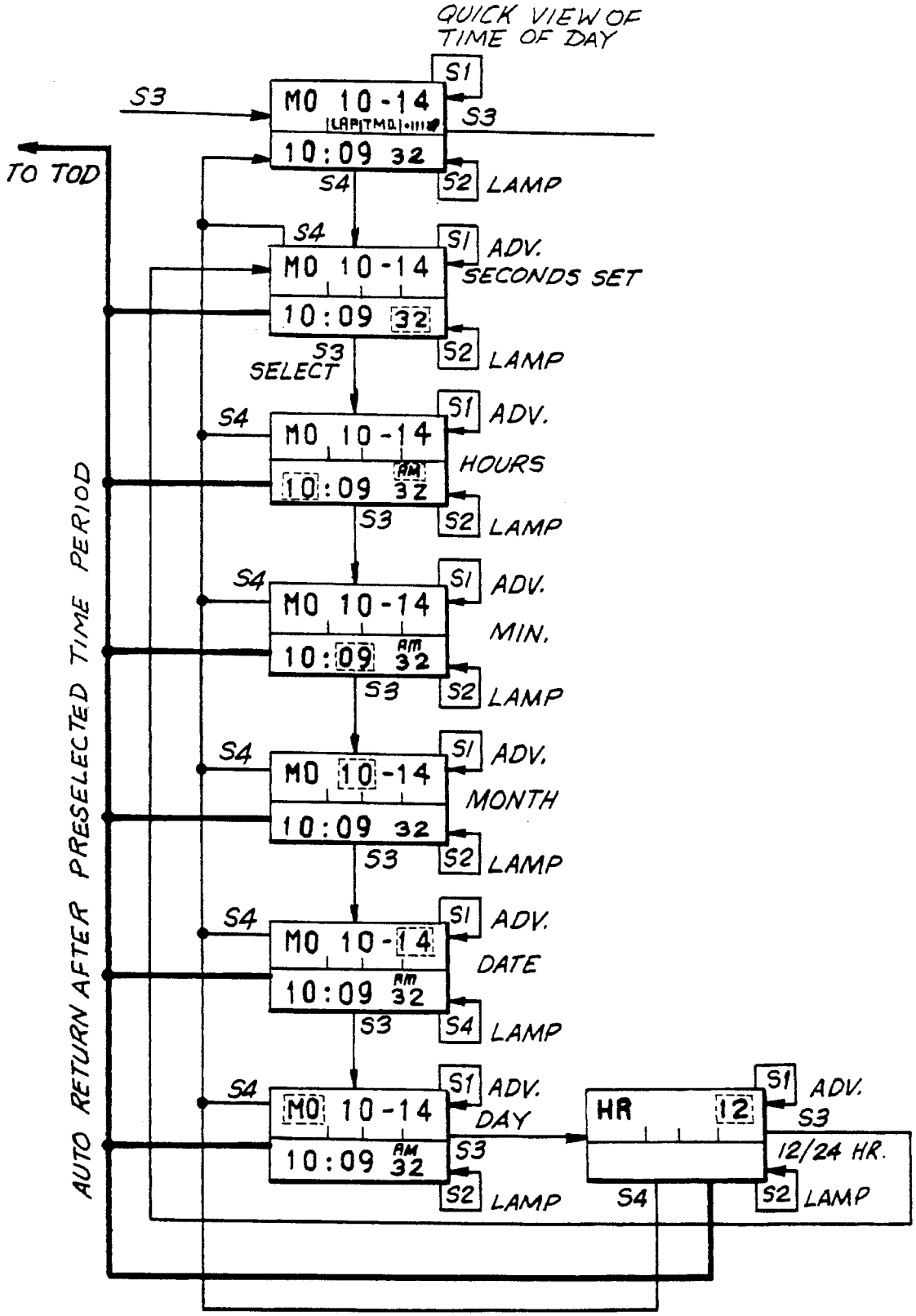
PRIOR ART FIG. 5
FIG. 5 is a detailed state diagram of alternate time zone set mode.

FIGS. 4 and 5 illustrate "state" diagrams in schematic form, for time-of-day setting and alternate time zone setting, respectively. Each of the top rectangles depicts the type of display shown on the electro-optic display 15 when the timepiece 1 is in that state. The large rectangles represent a state in which change of displayed information may be controlled by the operator. The rectangles outlined by dotted lines indicate which part of the displayed information is flashing and will accordingly be changed when switch S1 is actuated. The timepiece 1 continues to keep time and to operate under control of the particular subroutine of the operating system program in the microcomputer until the timepiece 1 is set into another state. Manipulation of the electronic wristwatch 1 to illuminate the display 15 and to execute the various functions and capabilities is by selective actuation of the manually actuated switches S1–S4. The well-known programming technique for determining whether the switches S1–S4 are opened or closed and then taking appropriate action is through the operating system program stored in the microcomputer memory, which tests each switch condition during each complete interrogation cycle. If any switch is closed, the program branches to a subroutine which initiates a counter. The counter determines how long the switch has been closed or, if the watch 1 has entered another state, how long it has been in that state.

Referring now to FIG. 4, the detailed state diagram of the TOD set mode is shown. This is the basic time-keeping function of the timepiece 1 and illustrates the general method of setting time-of-day. The integrated circuit 5 is programmed to set time-of-day in response to actuation of selected switches S1–S4 in a known manner. Once the SET subroutine is entered by pressing switch S4, a sequence is initiated by which information to be corrected may be selected by pressing switch S3. For example, in the fourth rectangle or block from the top, the minutes are selected for correction, as indicated by the rectangle outlined by dotted lines around "09". In an actual watch display 15, the "09" would flash on and off while the rest of the display remained on. Subsequent actuation of switch S1 will advance the minutes to a new setting. Actuating switch S4 while in the SET subroutine causes the wristwatch 1 to return to the TOD set mode. Auto Return to the TOD set mode from the SET subroutine occurs after a preselected period of time if none of the switches S1–S4 has been actuated.

FIG. 5 illustrates the T2 mode setting sequence. The integrated circuit 5 is programmed to set alternate time zone time in response to actuation of selected switches S1–S4. Once the setting sequence is entered by pressing switch S4, a piece of information to be corrected may be selected by pressing switch S3. Actuation of switch S1 advances the value of said piece of information to a new setting.

Figure 6:
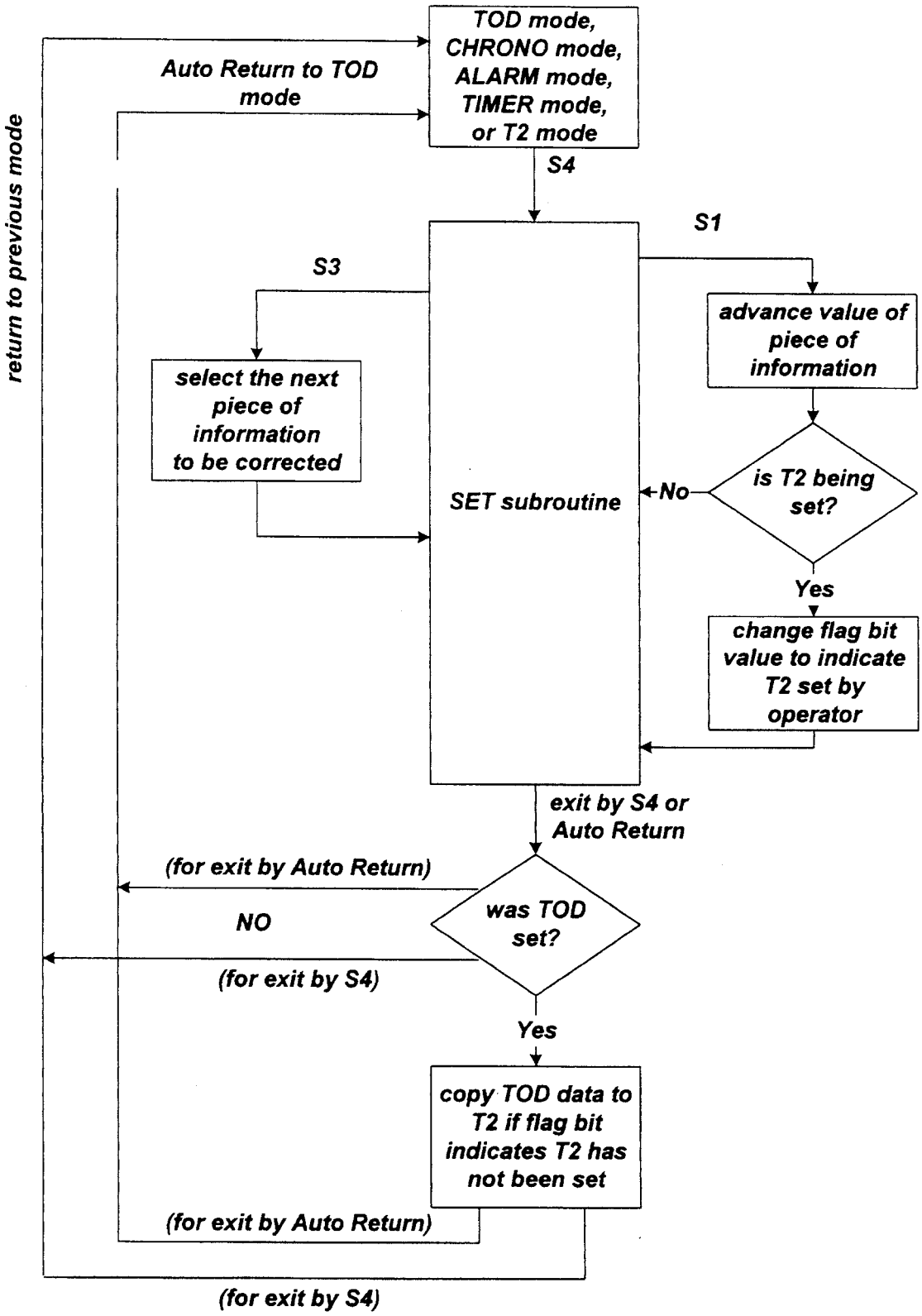
FIG. 6 shows a flow diagram of the present invention.

In accordance with the present invention, flag means are provided by which a flag bit can be set in one of the memory locations of the microcomputer 5. The value (0 or 1) of the flag bit depends upon the setting of the alternate time zone. If the alternate time zone information is set by the operator of the timepiece 1, the flag bit is set to one value. If the alternate time zone information is not set by the operator of the timepiece 1, then the flag bit is set to the other value. The operating system program of the timepiece 1 is programmed in a manner known to those skilled in the art to check whether the time-of-day set mode has been entered into and exited from. The operating program is further programmed in a manner known to those skilled in the art to determine whether the time-of-day information has been set by the operator. If the mode just exited from is the TOD set mode, the TOD mode has been set by the operator, and the flag bit value indicates that the alternate time zone information has not been set by the operator of the timepiece 1, then the operating program causes the integrated circuit 5 to copy the contents of the memory location storing the TOD data to the memory location for the T2 data. Otherwise, the integrated circuit 5 in the timepiece 1 causes either the previous mode (if exit was by actuating switch S4) or the TOD mode (if exit was by Auto Return) to be displayed on the electro-optic display 15. Note that the "previous mode" refers to the mode from which the SET subroutine was entered. After the TOD information is copied into the memory location for the T2 mode, the timepiece 1 returns to either the previous mode (if exit was by actuating switch S4) or the TOD mode (if exit was by Auto Return). A flow diagram of the present invention as described herein is shown as FIG. 6.

The operation of the timepiece 1 in accordance with the present invention would be as follows. Let's assume that the timepiece 1 has just been newly purchased or that its battery power source 9 has just been replaced. By design, the timepiece 1 will power up to the TOD mode displaying preselected information, such as Sunday, Jan. 1, 1995, 3:00 AM. Suppose the operator of the timepiece 1 changes the preselected time-of-day information to display his current day of the week (DOTW), date and time. Let's say that this is Wednesday, Aug. 13, 1996, 1:29 PM. When the operator exits the TOD set mode after making the necessary changes, the operating system program located in the integrated circuit 5 of the timepiece 1 causes the TOD information to be copied to the memory location for the alternate time zone as described above. Thus, the memory location for T2 would now contain Wednesday, Aug. 13, 1996, 1:29 PM. Let's assume that the operator of the timepiece 1 now wants to set T2 to a time which is six hours later than the TOD. To accomplish this, the operator will actuate switch S3 until the T2 mode is displayed. Once in the T2 mode, the operator need only advance the hours from "1" to "7", since the rest of the information is correct. Note the significant advantages proferred by the present invention. Unlike prior art timepieces, a timepiece in accordance with the present invention greatly simplifies the initial setting of the alternate time zone, irrespective of the specific identity of the alternate time zone.

When the operator of the timepiece 1 changes the T2 hours from "1" to "7", the flag bit value is altered to reflect the fact that the alternate time zone information has been set by the operator. Therefore, if the time-of-day information is later changed by the operator, this information would not be copied into the memory location for the T2 mode.

Although the present invention has been described with only one alternate time zone in mind, it should be apparent to those skilled in the art that the present invention may be modified without difficulty to accommodate several (or as many as desired) alternate time zones. The information in the TOD mode would be copied into the memory locations for all the alternate time zones not set by the operator.

While there has been described what is considered to be the preferred embodiment of the invention, other modifications will become known to those skilled in the art, and it is desired to cover in the appended claims all such modifications as fall within the true spirit and scope of the invention.

I claim:

1. An improved multimode electronic timepiece of the type having a display, a plurality of manually actuated switches, and an integrated circuit having memory locations, the integrated circuit being programmed to keep time, to provide a plurality of modes, including time-of-day and at least one alternate time zone, to permit an operator of the timepiece to set the time-of-day and the alternate time zone in response to actuation of selected switches, and to store the time-of-day and the alternate time zone data in the memory locations, wherein the improvement comprises:

flag means for copying the contents of the memory location storing the time-of-day data to the memory location for the alternate time zone data when the time-of-day has been set and the alternate time zone has not been set by the operator, the copied contents in the memory location for the alternate time zone data being displayed on the display in response to actuation of a selected switch and being changed in further response to actuation of selected switches, the flag means including a flag bit set in one of the memory locations of the integrated circuit, the value of the flag bit being dependent upon whether or not the operator has set the alternate time zone.

* * * * *